US007707958B2

(12) United States Patent
Hawkes

(10) Patent No.: US 7,707,958 B2
(45) **Date of Patent: *May 4, 2010**

(54) PROPULSION AND STEERING MECHANISM FOR AN UNDERWATER VEHICLE

(76) Inventor: Calvert T. Hawkes, 413 Partridge Cir., Sarasota, FL (US) 34236

( * ) Notice: Subject to any disclaimer, the term of this patent is extended or adjusted under 35 U.S.C. 154(b) by 0 days.

This patent is subject to a terminal disclaimer.

(21) Appl. No.: 12/428,138

(22) Filed: Apr. 22, 2009

(65) Prior Publication Data

US 2009/0208293 A1 Aug. 20, 2009

Related U.S. Application Data

(63) Continuation of application No. 11/502,084, filed on Aug. 10, 2006, now Pat. No. 7,540,255.

(60) Provisional application No. 60/710,552, filed on Aug. 23, 2005.

(51) Int. Cl.

| | |
|---|---|
| ***B63C 11/00*** | (2006.01) |
| ***B63C 11/48*** | (2006.01) |
| ***B63C 11/49*** | (2006.01) |
| ***B63G 8/08*** | (2006.01) |
| ***B63G 8/16*** | (2006.01) |

(52) U.S. Cl. ..... 114/312; 114/330; 114/338; 348/81

(58) Field of Classification Search ..... 114/312, 114/316–320, 330–333, 337, 338; 405/190, 405/191; 348/81; 396/25–29; 294/66.2
See application file for complete search history.

(56) References Cited

U.S. PATENT DOCUMENTS

| | | | | |
|---|---|---|---|---|
| 3,352,274 | A | 11/1967 | Clakins | |
| 3,521,589 | A | 7/1970 | Kemp | |
| 4,010,619 | A | 3/1977 | Hightower et al. | |
| 4,110,554 | A | 8/1978 | Moore et al. | |
| 6,091,443 | A | 7/2000 | Ford et al. | |
| 7,540,255 | B2 * | 6/2009 | Hawkes | 114/312 |

FOREIGN PATENT DOCUMENTS

| | | |
|---|---|---|
| EP | 385827 | 9/1990 |
| GB | 2181040 | 4/1987 |
| JP | 63093696 | 4/1988 |
| JP | 08230792 | 9/1996 |
| JP | 2006248277 | 9/2006 |

OTHER PUBLICATIONS

The Development of SeaPup—A Light Work Class ROV, RACAL Techno-Transfer Industries Pte Ltd, Published 1997 IEEE.

* cited by examiner

*Primary Examiner*—Ajay Vasudeva
(74) *Attorney, Agent, or Firm*—Maxey Law Offices, PLLC; Stephen Lewellyn

(57) ABSTRACT

A propulsion system is provided for an underwater vehicle such as a Remote Operated Vehicle (ROV). Two propellers are independently driven by motors, while the orientation of the propellers is simultaneously controlled by a third motor. A means is provided for reprogramming the control electronics that can be disabled when the vehicle is underwater. The control electronics also provides that all signals including video are transmitted to a base station without requiring coaxial cable.

5 Claims, 8 Drawing Sheets

PROPULSION AND STEERING MECHANISM FOR AN UNDERWATER VEHICLE

CROSS-REFERENCE TO RELATED APPLICATIONS

This application is a continuation of U.S. application Ser. No. 11/502,084, entitled "Propulsion and Steering Mechanism for an Underwater Vehicle", filed Aug. 10, 2006, now U.S. Pat. No. 7,540,255 B2, which claims priority to provisional patent application Ser. No. 60/710,552, filed Aug. 23, 2005, the entirety of both are incorporated herein by reference.

FIELD OF THE INVENTION

This invention is directed to a method of propulsion for underwater vehicle, and more particularly to a propulsion and steering mechanism for an underwater vehicle such as a Remote Operated Vehicle (ROV).

BACKGROUND OF THE INVENTION

Inspection class Remote Operated Vehicles (ROVs) are typically used to position a video camera underwater. The ROV usually contains electronics that are connected to a base station by a wire tether. Motor driven propellers called thrusters are used to move the ROV.

Current ROVs, for example as described in U.S. Pat. No. 6,662,742, generally use separate thrusters to control motion in the horizontal and vertical planes. For example, a pair of thrusters mounted horizontally on the sides of the ROV can move the ROV forwards, backwards and control azimuth, while another thruster mounted vertically can move the ROV up and down.

Since motors are generally heavy, this configuration is not optimally efficient. When the ROV is moving in the horizontal plane, the vertical thruster is essentially dead weight, so that the power to weight ratio is diminished. The situation is typically worse when moving vertically because the multiple horizontal thrusters that are idle reduce the efficiency even further.

Another problem with ROVs relates to the electronics. Control circuitry, which is generally not waterproof, is often housed in a watertight box. This allows for access to perform reprogramming of the electronics, but causes a problem because opening and resealing the watertight enclosure may be time consuming.

A solution to this problem may be to run the reprogramming signals through the tether, but this has the disadvantage of adding to the size, weight and cost of the tether.

Also, it may be desirable to encapsulate the electronics in epoxy, eliminating the need for a watertight enclosure for the electronics. This solution has not typically been employed in past ROVs because once encapsulated, either the electronics cannot be reprogrammed, or as mentioned above the reprogramming wires must be run through the tether.

Another problem with existing ROVs is that in general an expensive tether is required. This is because the tether typically contains power wires, control wires and video cable. Since video is usually a coaxial cable and the power and control signals are not, the tether must contain both standard unshielded wires for power and control and shielded coaxial cable for the composite video.

A standard solution is to use a custom cable for the tether, but this adds to the cost of the ROV. Another solution heretofore employed is to put batteries in the ROV eliminating the need to run power through the tether. This allows a single coaxial cable to be used for the tether, carrying modulated video and control signals. The problem with this method is that the batteries add weight to the ROV and the modulation circuitry can be expensive.

A need therefore exists for a propulsion system for an ROV that improves the power to weight ratio while allowing motion in both the horizontal and vertical planes. The electronics should be reprogrammable without requiring a watertight box or additional reprogramming wires in the tether, and the tether should supply video to the base station without requiring coaxial wires.

BRIEF SUMMARY OF THE INVENTION

This invention is directed to a method of propulsion for an underwater vehicle. Two propellers are independently driven by motors, while the orientation of the propellers is simultaneously controlled by a third motor. A means is provided for reprogramming the control electronics that can be disabled when the vehicle is underwater. The control electronics also provides that all signals including video are transmitted to a base station without requiring coaxial cable.

This invention uses two horizontally opposed propellers, which can be rotated into the horizontal or vertical planes, to drive the ROV. The control electronics includes an electrically isolatable programming port that allows the electronics to be reprogrammed. All signal including video are run through standard category 5 network cable (Cat5 cable), reducing weight and cost.

For the preferred embodiment, a separate motor drives each propeller and a single servo motor controls the orientation (horizontal, vertical or in between) of the propellers. To move in the horizontal plane, the motors can drive the ROV forward and backward by changing the direction of rotation of the propellers. Turning can be accomplished by varying the relative speed of the motors, and rotation about a point can be accomplished by running the propellers so as to create thrust in opposite directions.

To move the ROV up and down, the servo rotates the propellers to the vertical orientation. The direction of the propellers then controls whether the ROV moves up or down, and the relative speed of the propellers controls the roll of the ROV. In addition, the servo motor can position the propellers in between the horizontal and vertical planes, to provide a motion that combines both horizontal and vertical components. When operating in this manner, the floatation at the top of the ROV provides stability and reduces any tendency for unwanted roll.

The electronics provides a programming port that is exposed to the water. Two pins on the port are used to electrically isolate the port from the programming bus. In this manner, when being operated in the water, the pins can be shorted together by a shorting block and the programming port will be unaffected by any conductive effect of the water.

However, when the unit is on dry land and reprogramming is desired, the shorting block can be removed and the electronics can be connected to a reprogramming device by the programming port.

The camera is connected to the tether through a video balun, which converts the 75-ohm composite video, ordinarily requiring coaxial cable, to 100 ohm balanced signal compatible with standard low cost Cat5 cable. Additional pairs of the Cat5 cable are used for power, ground and control signals. In the base station, a second balun can be used to convert the video signal back into composite video if desired for recording, display or digitizing.

DETAILED DESCRIPTION OF THE INVENTION

Figure 1:
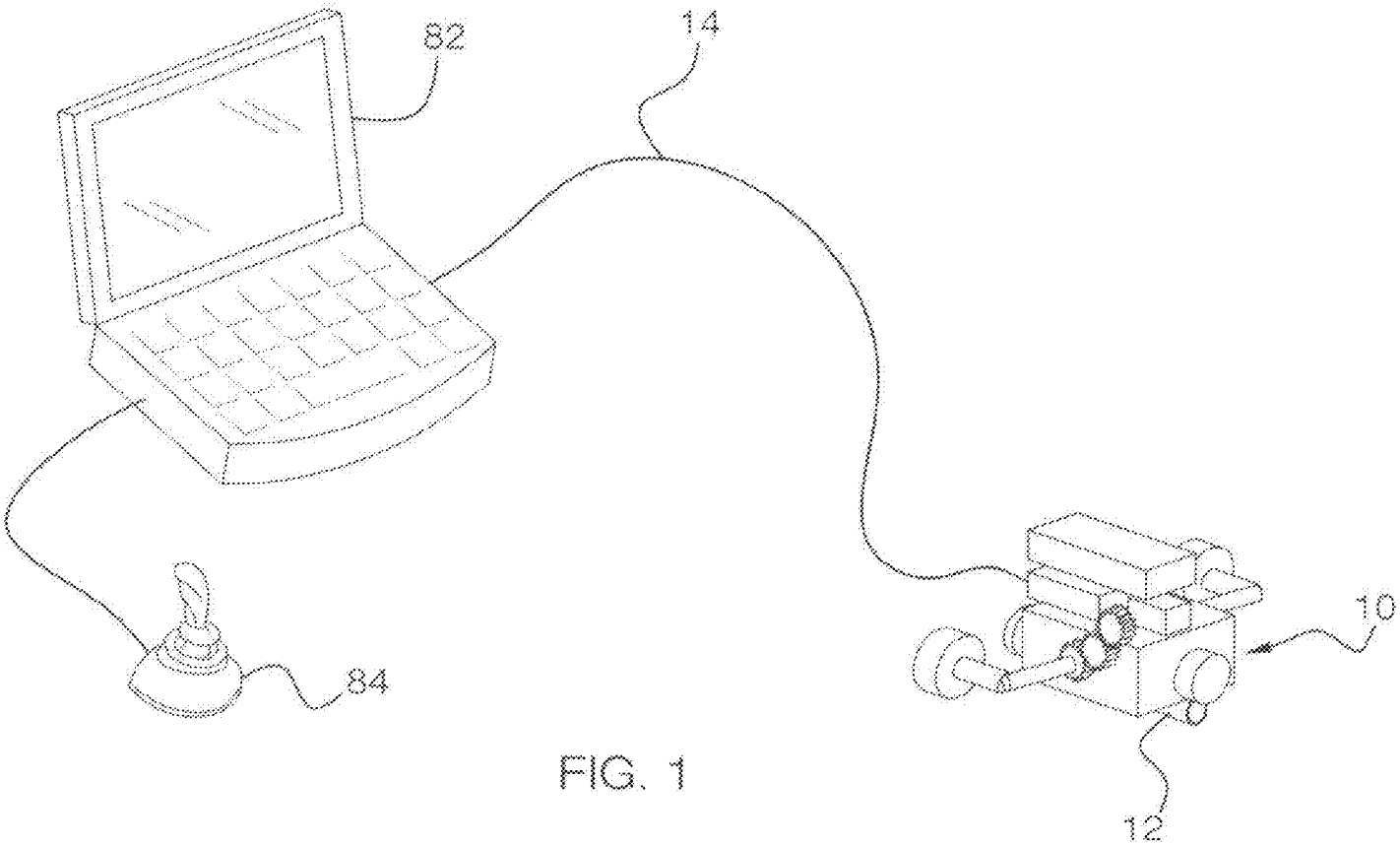
FIG. 1 is a diagrammatic illustration of a system constructed in accordance with the principals of the present invention.

FIG. 1 shows an illustration of the system, including Remote Operated Vehicle ROV 10 connected to base station 80 by tether 14. The output of ROV video camera 12 is displayed in real time on the screen of the laptop 82, and the joystick 84 is used to control the movement of the ROV 10.

Figure 2:
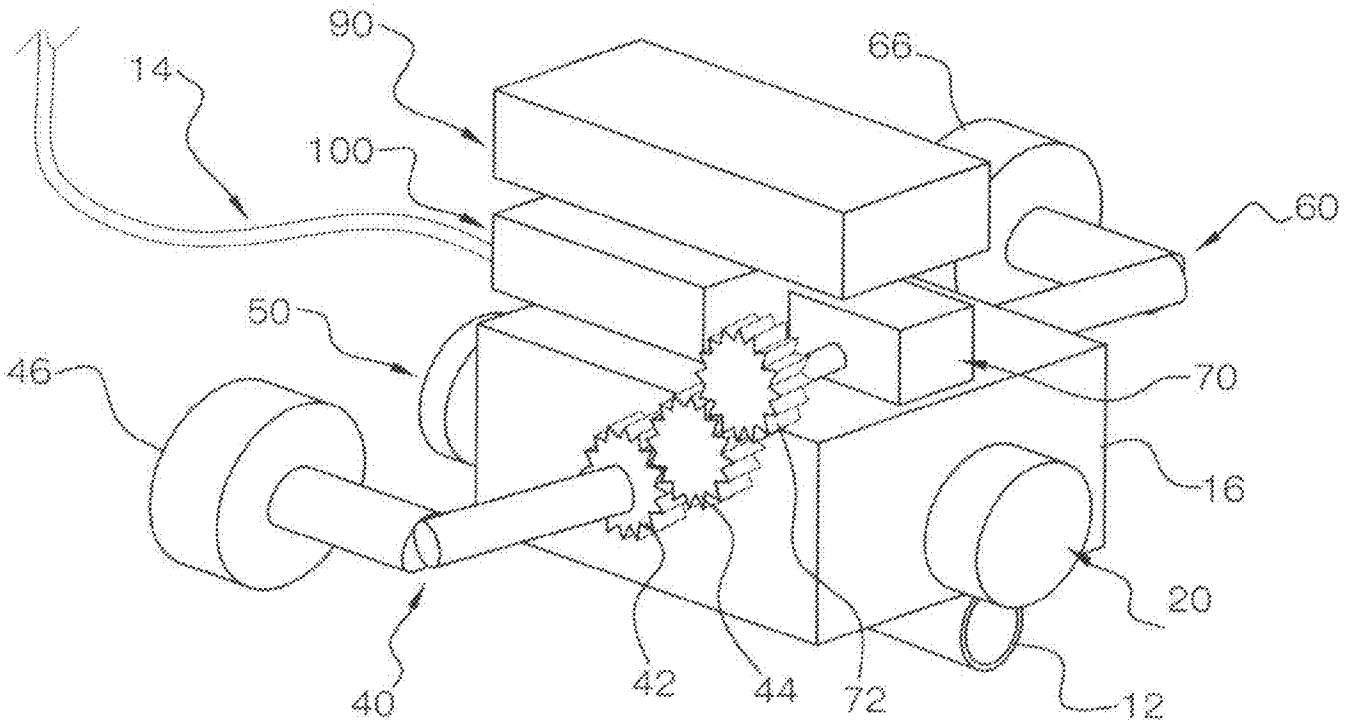
FIG. 2 is a diagrammatic right side perspective view of an underwater vehicle of the system of FIG. 1.

FIG. 2 shows a perspective view of the right side of ROV 10. The main components of ROV 10 are video camera 12, a right side thruster consisting of a drive motor 20 linked to propeller 46 through rotatable arm 40, a left side thruster consisting of drive motor 50 linked to propeller 66 through rotatable arm 60, and servo 70 to simultaneously rotate the arms 40 and 60.

Case 16 provides the attachment points for camera 12, drive motors 20 and 50, drive arms 40 and 60, servo 70, floatation 90 and control electronics 100. Floatation 90 counterbalances the weight of the ROV to provide approximately neutral buoyancy. For shallow operation, a block of closed cell foam can be used. For deeper operation, the foam can be covered in a solid outer shell such as fiberglass, or a sealed container or other hard buoyant object can be used for floatation.

Figure 3:
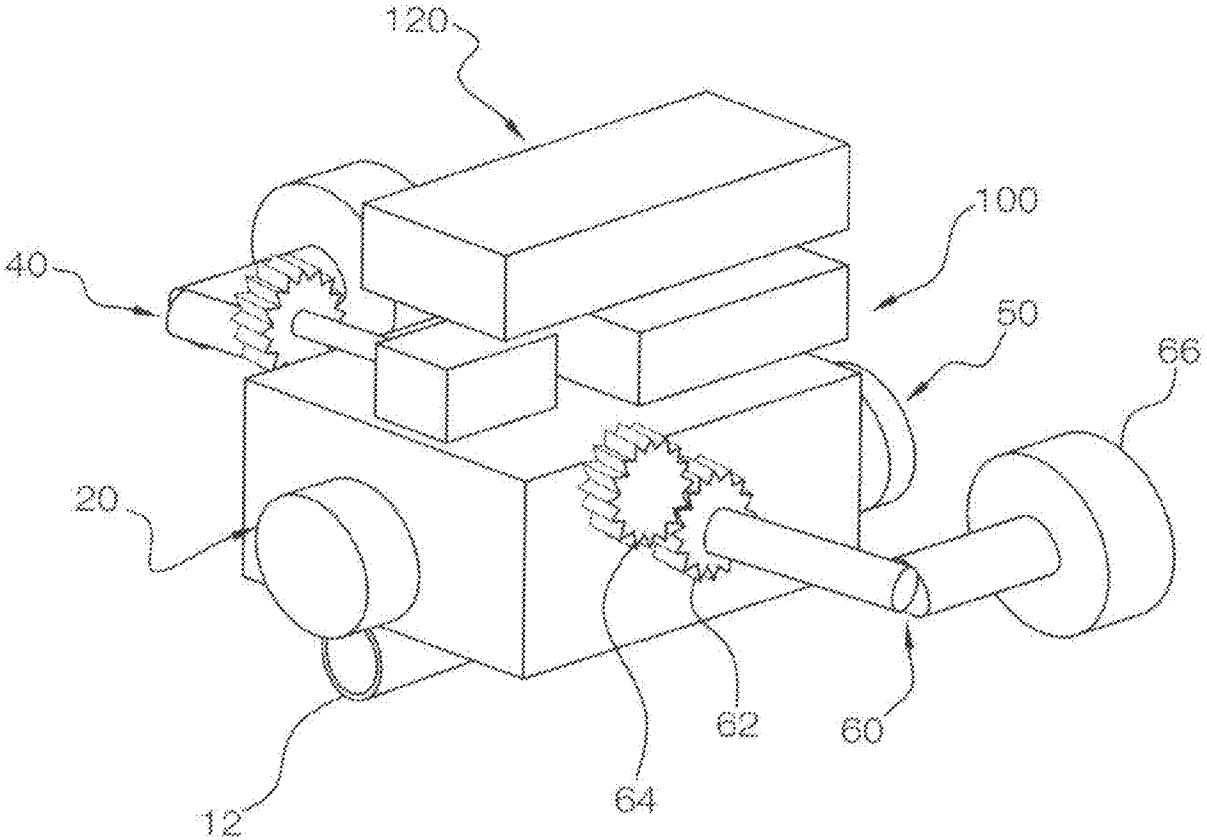
FIG. 3 is a diagrammatic left side perspective view of the underwater vehicle of FIG. 2.

Right arm gear 42 is connected to right arm 40, and the corresponding left arm gear 62 is connected to left arm 60. Servo gear 72 is connected to servo 70, and drives right idler gear 44, which also connects to rotation shaft 74. Shaft 74 also connects to left idler gear 64, shown in left perspective view FIG. 3. When servo 70 turns servo gear 72, right idler gear 44 rotates right arm 40 and also rotates rotation shaft 74 and left idler gear 64, which rotates left arm 60. In this fashion servo 70 controls the orientation of both right arm 40 and left arm 60 simultaneously.

Figure 4:
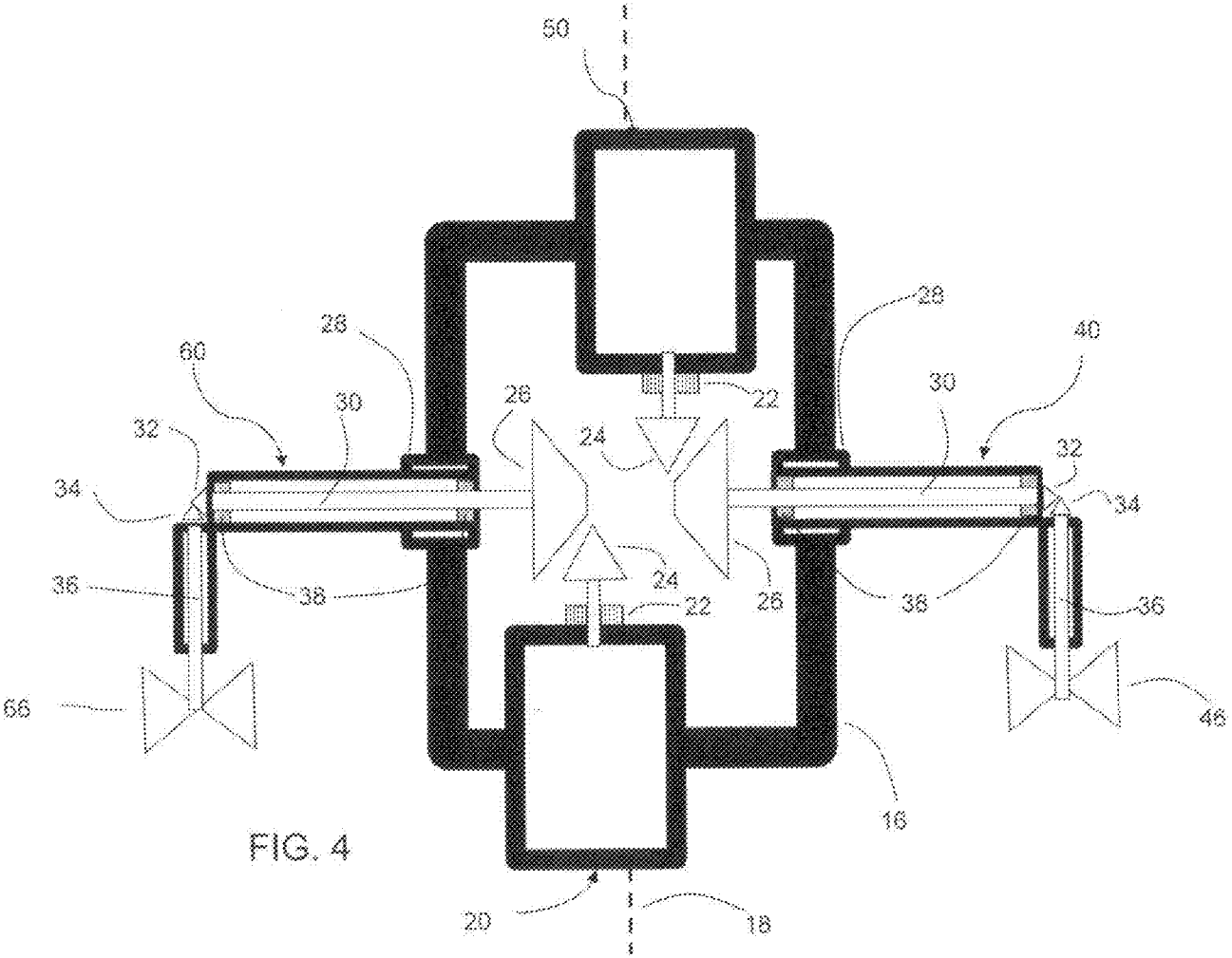
FIG. 4 is a simplified diagrammatic horizontal cross section of the drive and propulsion system.

FIG. 4 shows a cutaway view of the motor drive system. Drive motor 20 is offset from case 16 centerline 18 in order to avoid interference between right motor bevel gear 24 and left drive bevel gear 26. Similarly, drive motor 50 is offset from centerline 18 in order to avoid interference between left motor bevel gear 24 and right drive bevel gear 26. The offset is exaggerated in FIG. 4 for the sake of clarity.

In the preferred embodiment, drive motor 20 is housed in a watertight housing and protected from water ingress by shaft seal 22. Shaft seal 22 can be a simple lip seal for shallow water operation, or a higher performance seal for deep water use. Alternatively, a magnetic coupling could be used to isolate the motor from the seawater. Locating drive motor 20 in a watertight housing has some of advantages. First, there is no need to make case 16 waterproof because the gearing and shafts it contains can be made from materials compatible with submersible use. Second, the motor then becomes an easily replaceable part, allowing for standard motors to be replaced with higher performance motors for greater operating speed or operation at a greater depth.

In the preferred embodiment, drive motor 20 connects to motor bevel gear 24 that drives right drive bevel gear 26. Right drive bevel gear 26 connects to right drive shaft 30, which is supported by right shaft bearings 38. Drive shaft 30 is concentric with right arm 40. This allows right propeller 46 to be turned by motor 20 independently of the rotation of right arm 40. Drive shaft 30 is supported by sleeve bearing 38, which may for example be a flange mounted sleeve bearing.

The distal end of right drive shaft 30 connects to right end bevel gear 32 that drives right propeller bevel gear 34. Right propeller bevel gear 34 connects to right propeller shaft 36 and drives right propeller 46. The left side drive system is symmetrical to the right side drive system, with drive motor 50 connected to motor bevel gear 24 which drives left drive bevel gear 26. Left drive bevel gear 26 connects to left drive shaft 30, which is supported by left shaft bearings 38. For the preferred embodiment, right propeller 46 is a right hand propeller and left propeller 66 is a left hand propeller, i.e. right propeller 46 provides forward thrust when turning clockwise, and the left propeller 66 provides forward thrust when turning counterclockwise. This provides a balancing effect and prevents the direction of rotation of the propellers from inducing a rotational force to the ROV 10.

Figure 5:
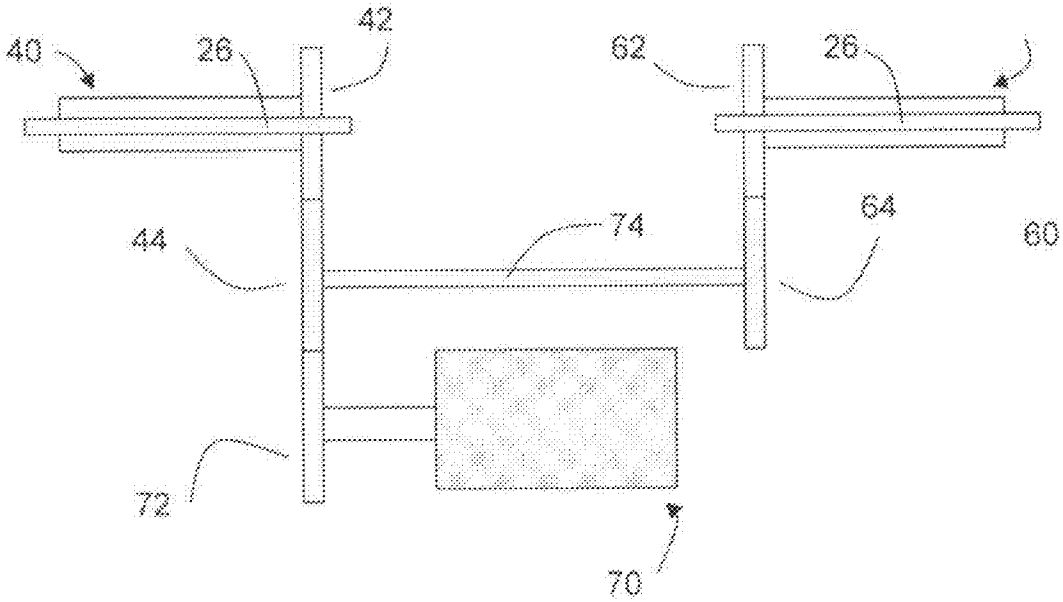
FIG. 5 is a simplified schematic view of the rotation mechanism.

FIG. 5 is a cutaway view of the servo driven rotation mechanism. For the preferred embodiment, servo 70 is a servo motor housed in a watertight housing. Since servo 70 typically moves with a range of plus or minus 90 degrees from the neutral horizontal position, a rotating shaft seal is not required and a low cost latex bellows can be used to seal the gear to the housing.

When servo 70 is driven clockwise when viewed from the right, it drives servo gear 72 clockwise. Servo gear 72 drives both idler gears by directly driving right idler gear 44 and indirectly driving left idler gear 64 which is connected to right idler gear 44 by rotation shaft 74. The rotation of the idler gears will be opposite that of the servo, so that when the servo is driven clockwise, both idler gears will turn counterclockwise.

Each idler gear in turn drives the associated arm gear; right idler gear 44 drives right arm gear 42, and left idler gear 64 drives left arm gear 62. Counterclockwise motion of the idler gears causes clockwise motion of the arm gears, with the net effect being that when the servo 70 moves clockwise both arms move clockwise.

Figure 6:
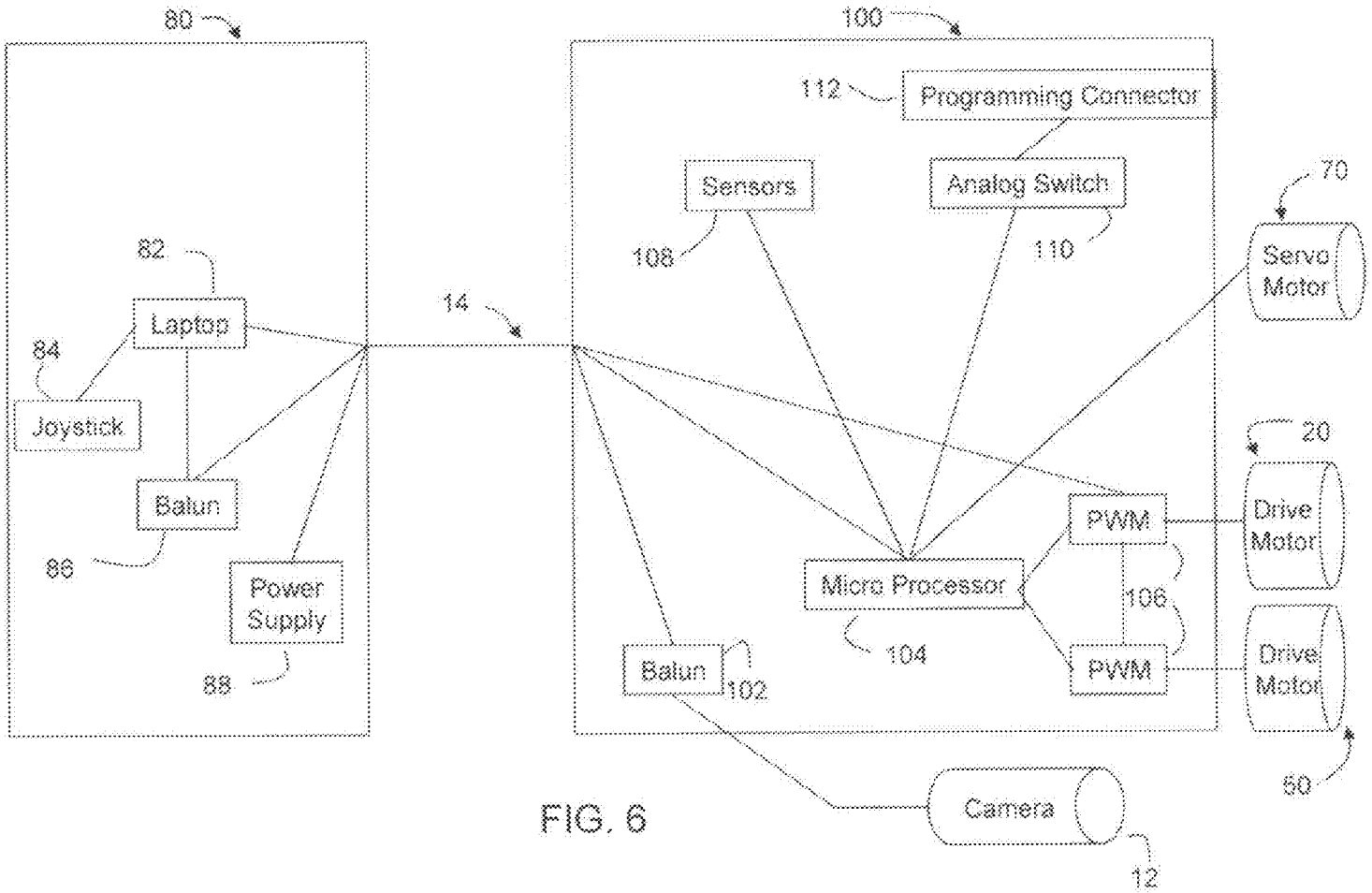
FIG. 6 is a schematic view of the system of FIG. 1.

FIG. 6 shows a block diagram of the electrical connections of the system. There are two major electrical components: base station 80 and control electronics 100 located in ROV 10. Base station 80 consists of a processing unit such as laptop PC 82, power supply 88, and joystick 84 to control the motion of ROV 10.

Control electronics 100 contains microprocessor 104, which is typically a low cost 8-bit microprocessor. Sensors 108 are connected to microprocessor 104. A variety of sensors can be used, typically consisting of an accelerometer to provide roll and pitch, an electronic compass to provide heading, and a depth sensor. Microprocessor 104 is also connected to pulse width modulator (PWM) circuits 106 for drive motors 20 and 50. PWM circuits 106 are used to independently control the speed and direction of each drive motor.

In the preferred embodiment, all signals between base station 80 and the control electronics 100 are run through 100 feet of standard Cat5 cable, which contains four twisted pairs of 24 gauge wire. Two pairs are used to carry power from base station 80 to ROV 10. Another pair of wires is allocated to the control signals, with one wire for transmit and one wire for receive. Any appropriate electrical interface may be used for the control signals; in the preferred embodiment, RS-232 serial interface is used to send data to and from the ROV. The final pair of wires in tether 14 is used to carry video.

In base station 80, the two pairs dedicated to power are connected to power supply 88. For example, power supply 88 may generate 24 volts DC. One pair of wires is connected to +24 volts and one pair of wires is connected to ground. The pair of wires allocated to control signal is connected to the serial port of laptop 82. The pair of wires for video is connected to balun 86.

In control electronics 100 in ROV 10, the pair of wires for power is connected directly to PWM circuits 106, and is also used to supply power to the rest of the circuitry in control electronics 100 and to camera 12. In the preferred embodiment, control circuitry 100 requires 3.3 volts, and camera 12 requires 12 volts, so voltage regulators are used to convert the 24 volts from power supply 88 into the appropriated level as required. The control electronics may also contain a programming port connected to microprocessor 104 through an analog switch 110. The switch can be disabled by shorting together two pins on programming connector 112, allowing the connector to be isolated from the microprocessor.

Figure 7:
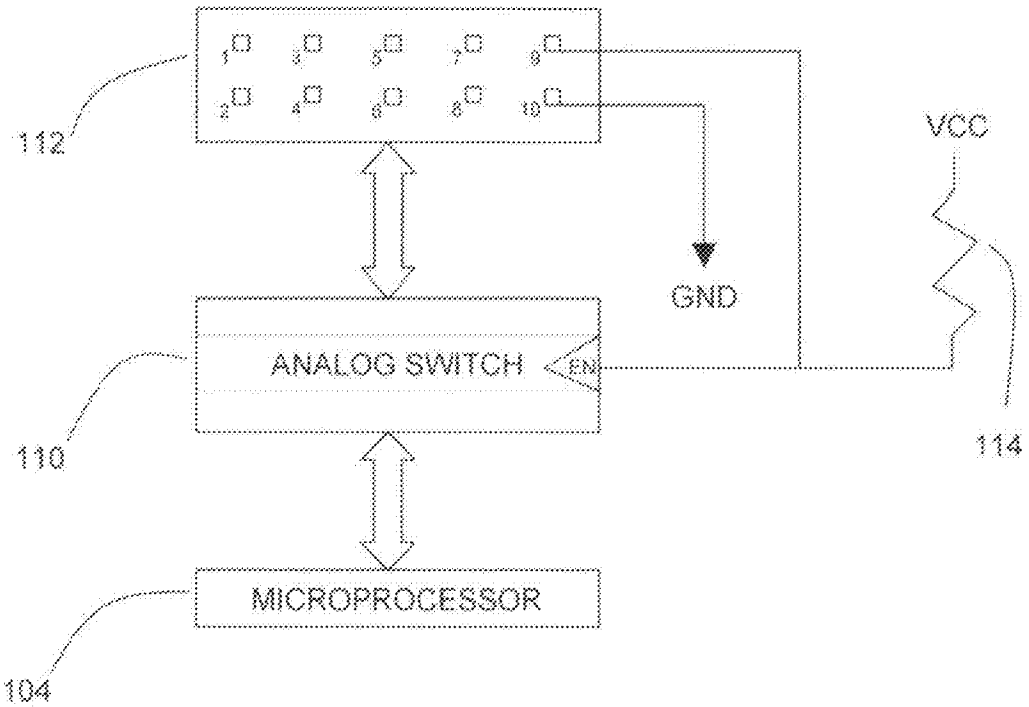
FIG. 7 is a detailed schematic of a programming port of the system of FIG. 1.

FIG. 7 shows a detailed schematic of the programming port. In the preferred embodiment, programming connector 112 is a 10 pin connector used to connect to the JTAG programming port on microprocessor 104. Programming connector 112 is positioned on the outside of ROV 10, where it will come in contact with sea water which has conductive properties. Analog switch 110 is connected in between microprocessor 104 and programming connector 112. Pin 9 of programming connector 112 is used to enable or disable the programming port. When pin 9 is unconnected, resistor 114 pulls up the enable input of analog switch 110, enabling the switch and allowing microprocessor 104 to be reprogrammed. When pin 9 is connected to pin 10, for example by a shorting block, jumper, or similar connection, the enable input of analog switch 110 will be a zero potential disabling the programming port. With the jumper in place, programming connector 112 is effectively disconnected from microprocessor 104.

During normal operation, output of camera 12 is shown in real time on screen of laptop 82. Laptop 82 also displays output of sensors 108 (for example roll, pitch, and yaw) and may also display any other pertinent local information such as time, date and GPS coordinates. Laptop 82 may also save video, sensor and local data on its hard drive, CD or DVD storage. In addition, video may also be saved on an external VCR or other recording device, not shown.

The base station uses a command structure to encode the desired speed and direction for the drive motors 20 and 50, and the desired rotation for servo motor 90. Base station 80 also periodically polls the ROV 10 to determine the current status of sensors 108. Since output of the sensors may be relevant information used in piloting the ROV 10, base station 80 may poll sensor 108 status many times a second, so that base station 80 can display current sensor data in real time.

Joystick 84 is used to pilot the ROV 10 so as to position ROV 10 in order to capture the desired information on video. For the preferred embodiment, a 3D joystick is used. Forward and backward motion of the joystick 84 is used to control the angle of rotation of the propellers, with the neutral position of joystick 84 corresponding to a horizontal orientation of the propellers. Depth of the ROV 10 is controlled as follows: pushing the joystick forward will cause the ROV 10 to descend, and pulling the joystick back causes the ROV 10 to move toward the surface.

Figure 8A:
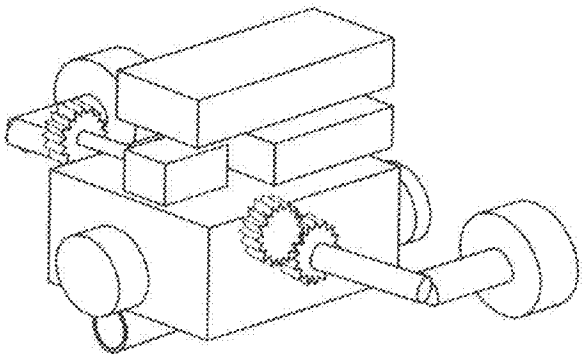
FIG. 8A is a diagrammatic perspective view of the underwater vehicle showing the propellers disposed in a horizontal orientation.
Figure 8B:
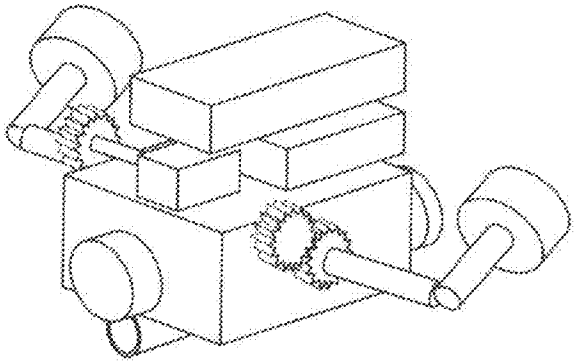
FIG. 8B is a diagrammatic perspective view of the underwater vehicle showing the propellers disposed in a generally 45-degree orientation.
Figure 8C:
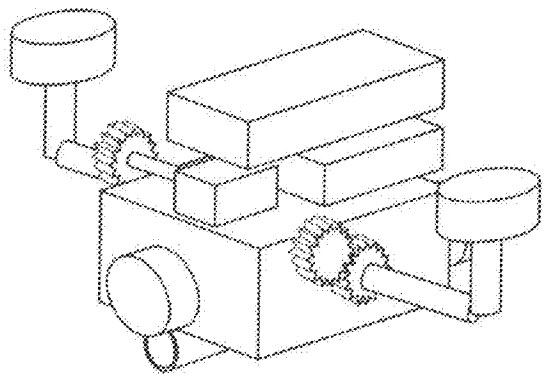
FIG. 8C is a diagrammatic perspective view of the underwater vehicle showing the propellers disposed in a generally vertical orientation.

FIGS. 8A to 8C show the propeller position corresponding to the position of joystick 84. FIG. 8A corresponds to the neutral position of joystick 84, and ROV 10 will move forward horizontally when thrust is applied. FIG. 8B corresponds to joystick 84 being pushed forward approximately 50%; this will cause ROV 10 to descend at about a 45 degree angle when forward thrust is applied. FIG. 8C corresponds to joystick 84 being pushed all the way forward and ROV 10 will descend vertically when thrust is applied.

Joystick 84 also has a throttle lever, which moves between off (no thrust) and on (full thrust). Laptop 82 in turn sends commands to ROV 10 to control the voltage applied to the drive motors 20 and 50 using the PWM controllers in the ROV control electronics 100.

Azimuth of the ROV 10 is controlled by joystick 84 in two ways: when throttle is on, relative power to the drive motors is modified according to the side to side position of joystick 84. The neutral (centered) position corresponds to equal power to the drive motors; joystick 84 moved to the right corresponds to increased power to the left drive motor 50, and joystick 84 moved to the left corresponds to increased power to right drive motor 20. In this manner the operator may move joystick 84 right to go right and move joystick 84 left to go left.

Another way to control azimuth by joystick 84 is by twisting the joystick. When laptop 82 detects clockwise twist of joystick 84, forward thrust is generated on left drive motor 50 and reverse thrust is generated with right drive motor 20. This caused the ROV 10 to pivot in place, allowing camera 12 to be panned to the right. The speed of the motion is proportional to the amount of rotation of joystick 84. A symmetrical but opposite motion is generated when joystick 84 is twisted to the left; i.e. camera 12 is panned to the left.

One potential limitation of the preferred embodiment may be the cost of laptop 82. This could be ameliorated by using a custom display to show output of camera 12 and additional custom electronics in the base station to replace the functionality of the laptop in interfacing joystick 84 to tether 14.

Regarding attachment of drive motor 20 and 50 to case 16, the drive motors could be attached perpendicular to centerline 18. This would allow motor bevel gears 24 to be replaced with pinion gears, and drive bevel gears to be replaced with spur gears, potentially providing a wider range of available gear ratios and lower cost.

Regarding the placement of the motor shaft seals 22, case 16 could be made waterproof and motor shaft seals 22 could be moved into the drive arms. This would allow the servo 70 and control electronics 100 to be moved inside case 16, and would reduce the size of floatation 90 by reducing the submerged weight of case 16.

Power supply 88 is describes as a 24 volt supply for the preferred embodiment. However, other voltages could be used and may be advantageous in certain circumstances. For example, if tether 14 were longer that the 100 feet of the preferred embodiment, it may be desirable to used a higher voltage to reduce the necessary current and thus lower the voltage drop across the cable.

While the instant invention has been shown and described herein in what are conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A remotely operated underwater vehicle comprising:

a case;

two thrusters positioned on either side of said case, each operable to generate a thrust, a first thruster of said two thrusters including a first drive motor operatively coupled to a first propeller, a second thruster of said two thrusters including a second drive motor operatively coupled to a second propeller, said first and second drive motors attached to said case, and said first and second propellers being rotatable relative to the case between horizontal and vertical positions;

a rotatable support for supporting each of said first and second propellers for rotation between said horizontal and vertical positions;

a drive mechanism for rotating said rotatable support to selectively vary in unison the direction of thrust of said two thrusters to control the direction of movement of the underwater vehicle;

each of said first and second propellers being independently driven to control the speed and lateral direction of the underwater vehicle;

a base station;

control electronics at said case;

a tether operably connecting said base station to said control electronics;

said tether is unshielded and consists of four pairs of twisted wire; and a camera attached to said case, said camera operatively connected to said control electronics and producing a video signal, said video signal being transmitted from said control electronics to said base station on a first pair of twisted wire of said four pairs of twisted wire.

2. The vehicle of claim 1, further comprising:

a first gear train, wherein said first drive motor and said first propeller are operatively coupled by said first gear train; and a second gear train, wherein said second drive motor and said second propeller are operatively coupled by said second gear train.

3. The vehicle of claim 2, wherein said rotatable support includes:

a first rotatable arm extending from one side of the underwater vehicle, wherein said first propeller is supported by said first rotatable arm; and a second rotatable arm extending from the other side of the underwater vehicle, wherein said second propeller is supported by said second rotatable arm.

4. The vehicle of claim 3, wherein said drive mechanism includes:

a servo motor connected to said first arm and to said second arm and operable to rotate said first and said second arms in unison.

5. The vehicle of claim 1, wherein power from said base station is carried to said control electronics on a second and third pair of twisted wire of said four pairs of twisted wire; and wherein control signals between said control electronics and said base station are carried on a fourth pair of twisted wire of said four pairs of twisted wire.

* * * * *